US007417524B2

(12) United States Patent
Lien et al.

(10) Patent No.: US 7,417,524 B2
(45) Date of Patent: Aug. 26, 2008

(54) MAGNETIC-BIAS FERROMAGNETIC SPIRAL INDUCTOR

(75) Inventors: Wai-Yi Lien, Hsin-Chu (TW); Denny Tang, Saratoga, CA (US); Wen-Chin Lin, Hsin-Chu (TW); Chao-Hsiung Wang, Hsinchu (TW)

(73) Assignee: Taiwan Semiconductor Manufacturing Co., Ltd., Hsin Chu (TW)

( * ) Notice: Subject to any disclaimer, the term of this patent is extended or adjusted under 35 U.S.C. 154(b) by 301 days.

(21) Appl. No.: 11/353,215

(22) Filed: Feb. 13, 2006

(65) Prior Publication Data

US 2007/0188287 A1 Aug. 16, 2007

(51) Int. Cl.
*H01F 5/00* (2006.01)

(52) U.S. Cl. ..... 336/200; 336/223; 336/232

(58) Field of Classification Search ..... 336/200, 336/223, 232
See application file for complete search history.

(56) References Cited

U.S. PATENT DOCUMENTS 5,583,474 A * 12/1996 Mizoguchi et al. ..... 336/83
7,224,254 B2 * 5/2007 Choi et al. ..... 336/200
2003/0193743 A1 * 10/2003 Sasaki et al. ..... 360/126

* cited by examiner

*Primary Examiner*—Anh T Mai
(74) *Attorney, Agent, or Firm*—Tung & Associates PLL

(57) ABSTRACT

A semiconductor device having a semiconductor substrate and a first insulator overlying the semiconductor substrate. A spiral coil inductor overlies the first insulator and a second insulator overlies the spiral coil inductor. A patterned ferromagnetic film overlies the second insulator and a patterned magnetic-bias film overlies the patterned ferromagnetic film.

19 Claims, 5 Drawing Sheets

MAGNETIC-BIAS FERROMAGNETIC SPIRAL INDUCTOR

FIELD OF THE INVENTION

The present invention relates to semiconductor devices including an inductor.

BACKGROUND OF THE INVENTION

Inductance is the ability of a device to store energy in the form of a magnetic field. An inductor is an electronic component designed specifically to provide a controlled amount of inductances. Inductors generally consist of a length of wire wound around a solenoidal or toroidal shape. The inductance may be increased by placing a core with a high magnetic permeability within the core. Suitable materials such as iron, powdered iron and ferrite may be utilized. Commercially made inductors have values ranging from less than 1 microhenrys (μH) to about 10 Henrys (H). Small inductors have been used in radio-frequency tuned circuits and as radio-frequency chokes. Large inductors have been utilized at audio frequencies with the largest inductors being used as filter chokes in power supplies.

Coil-shaped inductors are used in tuned circuits for audio frequencies to the ultrahigh radio-frequency region. In the ultrahigh-frequency and microwave bands, short links of transmission lines can serve as inductors. Any length of line shorter than ¼ electrical wavelength short-circuited at the far end acts as an inductor. The same is true of a section of line between ¼ and ½ wavelength, with an open circuit at the far end.

A perfect inductor shows only inductive reactance, and no resistance. Such a perfect inductor exists only in theory and real inductors have some ohmic loss as well as reactance. Inductors have been utilized in semiconductor devices, and those skilled in the art continue to develop semiconductors with inductor assemblies having improved properties.

The present invention provides alternatives to the prior art.

SUMMARY OF THE INVENTION

One embodiment of the present invention includes a semiconductor device including a semiconductor substrate and a first insulator overlying the semiconductor substrate. A spiral coil inductor overlies the first insulator and a second insulator overlies the spiral coil inductor. A patterned ferromagnetic film overlies the second insulator and a patterned magnetic-bias film overlies the patterned ferromagnetic film.

Another embodiment of the present invention includes a semiconductor device including a semiconductor substrate and a first insulator overlying the semiconductor substrate. A spiral coil inductor overlies the first insulator and a second insulator overlies the spiral coil inductor. A first ferromagnetic film overlies the second insulator and a first patterned magnetic-bias film overlies the first patterned ferromagnetic film. A multi-layer assembly is interposed between the first insulator and the spiral coil inductor. The multi-layer assembly includes a second patterned ferromagnetic film overlying the first insulator and a second patterned magnetic-bias film overlying the second patterned ferromagnetic film. A third insulator overlies the second patterned magnetic-bias film.

Other embodiments of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is/are merely exemplary in nature and is in no way intended to limit the invention, its application, or uses.

Figure 1:
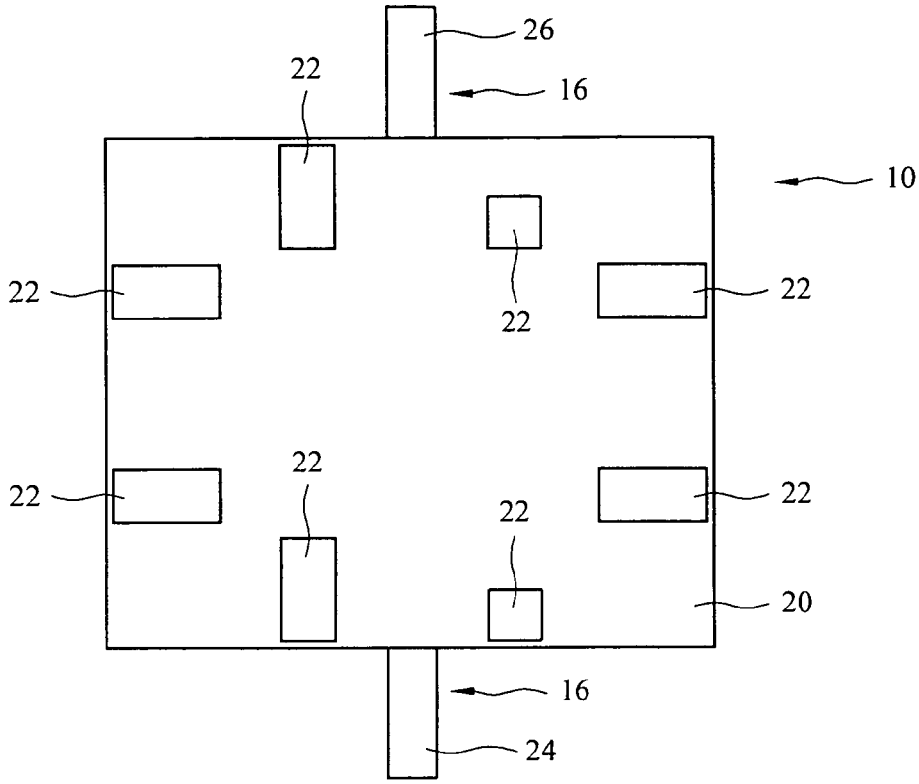
FIG. 1 is a plan view of a semiconductor device according to the present invention illustrating a patterned magnetic-bias film overlying a patterned ferromagnetic film that covers the turns of a spiral coil inductor with leads extending outwardly from the patterned ferromagnetic film.
Figure 2:
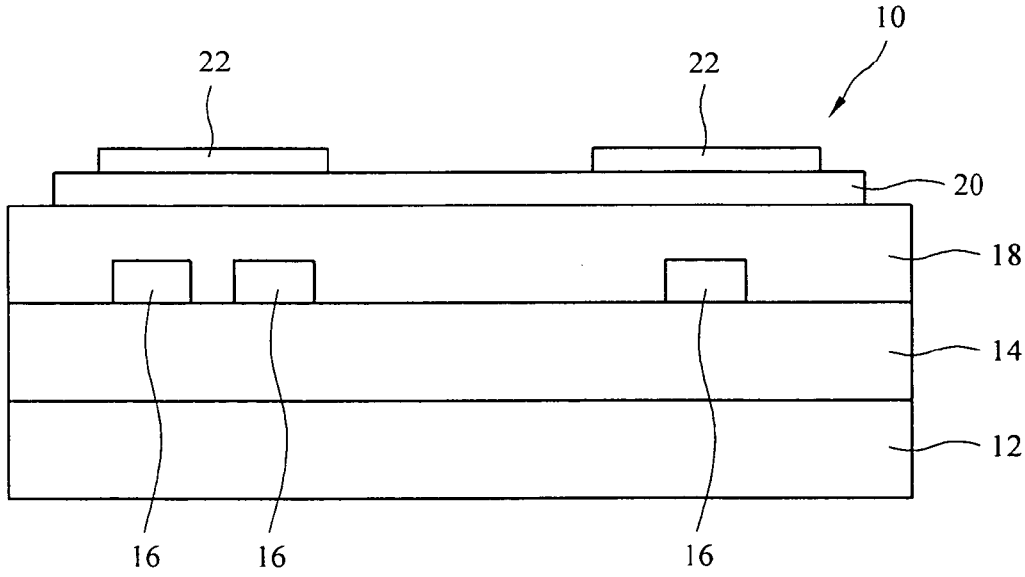
FIG. 2 illustrates one embodiment of a semiconductor device according to the present invention.

Referring now to FIGS. 1 and 2, one embodiment of the present invention includes a semiconductor device 10 including a semiconductor substrate 12. Any semiconductor substrate 12 known to those skilled in the art may be utilized and may include, but not limited to, silicon, Ge, In, Ca, As and Sn. The substrate 12 may be doped with a variety of dopants including boron and phosphorus to define discrete electronic devices therein. A first insulator 14 overlies the semiconductor substrate 12. The first insulator 14 may be made from any dielectric material known to those skilled in the art including, but not limited to, silicon dioxide, silicon nitride, polyimide and spin-on-glass. A spiral coil inductor 16 overlies the first insulator 14. The spiral coil inductor 16 may be made from any electrically conductive material including, but not limited to, copper, aluminum, silver, and gold. In one embodiment, the spiral coil inductor 16 is formed of Cu, or AlCu or other Cu based alloys. A second insulator 18 overlies the spiral coil inductor 16. In one embodiment, the second insulator 18 completely covers the spiral coil inductor 16, encapsulating the same, and provides a dielectric core in the center of the spiral coil inductor 16. The second insulator 18 may be manufactured from materials that are the same as those of the first insulator 14. A patterned ferromagnetic film 20 overlies the second insulator 18 and is positioned to completely cover the turns of the spiral coil inductor (best seen in FIG. 5). In one embodiment of the invention, the patterned ferromagnetic film 20 may include at least one of Fe, Co, Ni, Mo and alloys thereof. A patterned magnetic-bias film 22 overlies the patterned ferromagnetic film 20. In one embodiment the patterned magnetic-bias film 22 includes, but is not limited to, iron. The patterned ferromagnetic film 20 and the patterned magnetic-bias film 22 may be formed by any method known to those skilled in the art, including but not limited to, screen printing. The coil includes a first lead 24 and a second lead 26.

Figure 3:
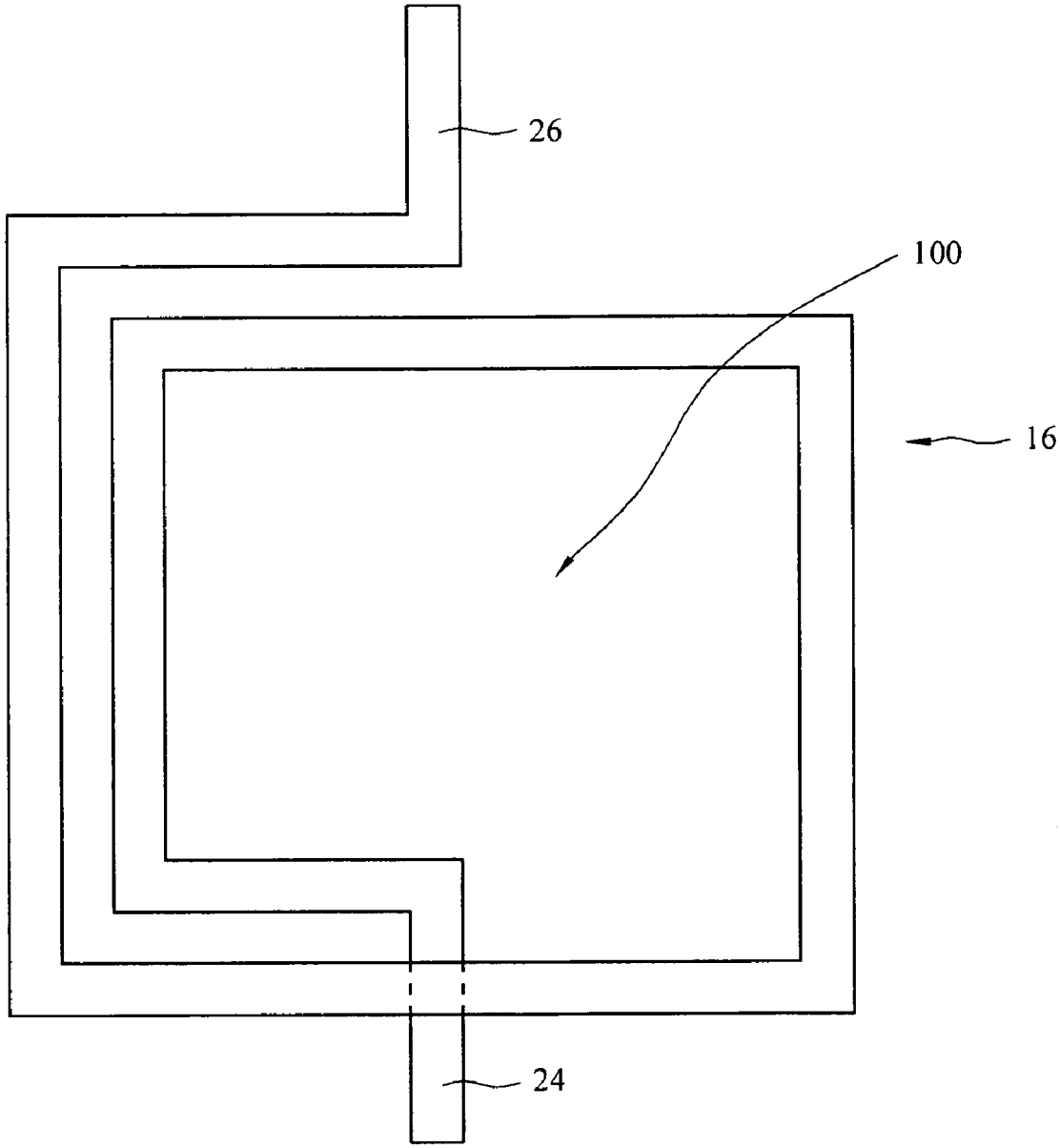
FIG. 3 illustrates one embodiment of a spiral coil inductor according to the present invention.
Figure 4:
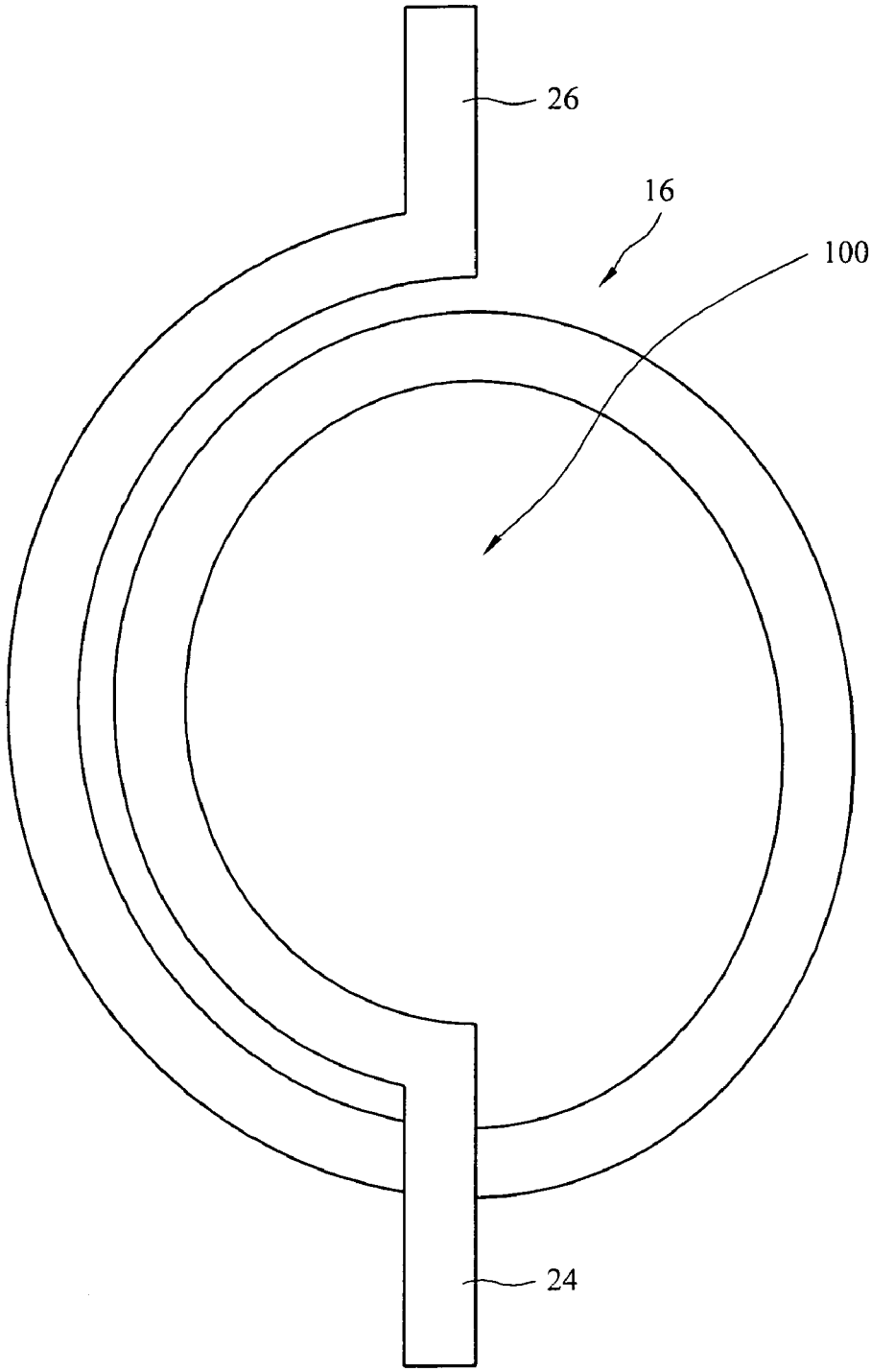
FIG. 4 illustrates one embodiment of a spiral coil inductor according to the present invention.

Referring now to FIGS. 3 and 4, the spiral coil inductor 16 according to the present invention may be formed in a variety of configurations including a rectangular or square shaped coil as illustrated in FIG. 3 having a plurality of straight segments, with adjacent straight segments formed at 90° (ninety degree) angles to each other surrounding core 100. Alternatively, the spiral-shaped coil inductor 16 may include circular-shaped segments as shown in FIG. 4 surrounding a core.

Figure 5:
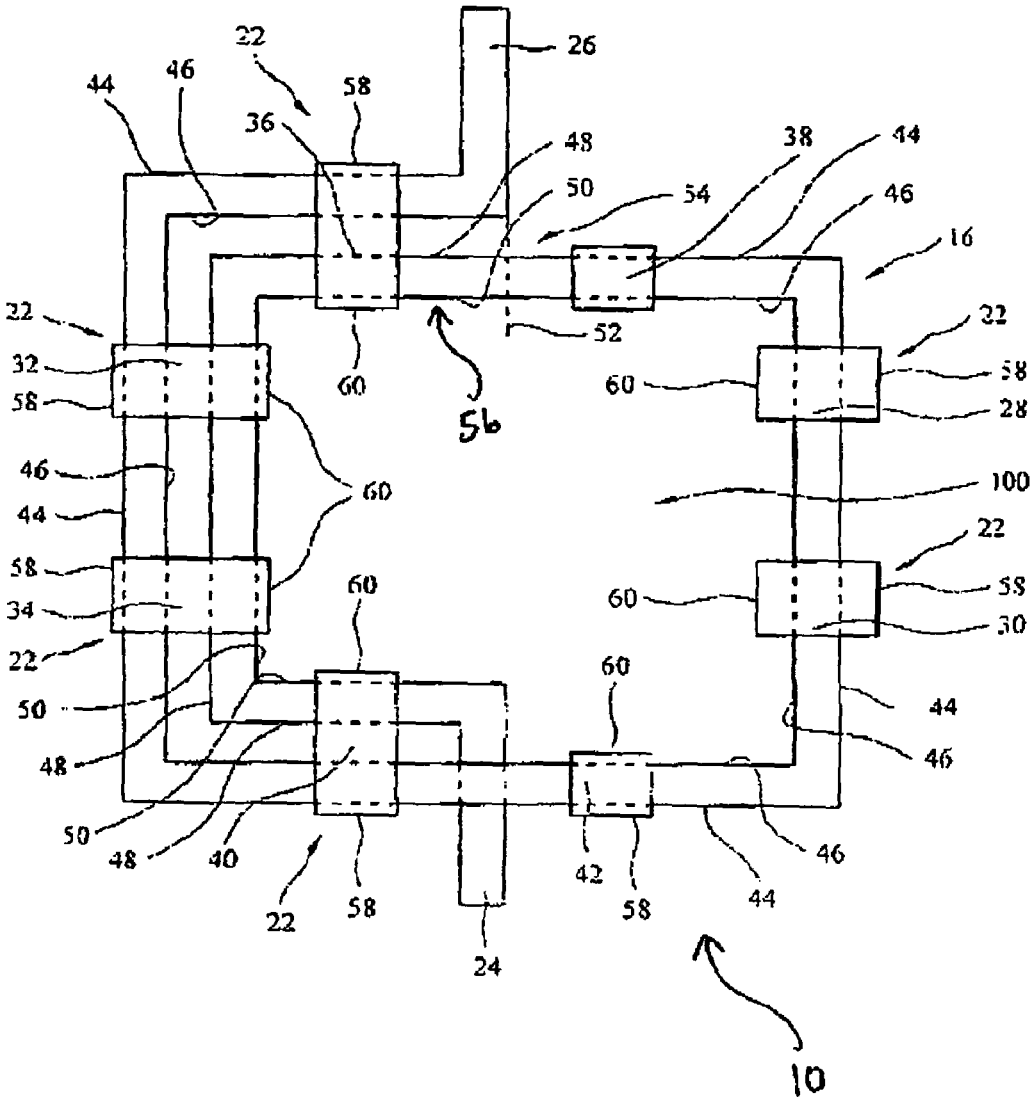
FIG. 5 illustrates one embodiment of the present invention showing the spatial relationship of elements of the patterned magnetic-bias film with respect to the spiral coil inductor of the present invention.

Referring now to FIG. 5, one embodiment of the invention includes a semiconductor device 10 wherein the patterned ferromagnetic film 20 completely covers the turns of the spiral coil inductor 16. However, in FIG. 5 the patterned ferromagnetic film 20 has been removed to illustrate the alignment of the patterned magnetic-bias film 22 elements to turn segments of the coil 16. Each element of the patterned magnetic-bias film 22 overlies the patterned ferromagnetic film 20 and each element of the patterned magnetic-bias film 22 is aligned with the patterned ferromagnetic film 20 so as not to extend beyond the outer edges of the patterned ferromagnetic film 20 (best seen in FIG. 1).

Referring now again to FIG. 5, a semiconductor device 10 according to one embodiment of the invention includes a patterned magnetic-bias film 22 which includes a first element 28, a second element 30, a third element 32, a fourth element 34, a fifth element 36, a sixth element 38, a seventh element 40 and an eighth element 42. Each of the elements 28, 30, 32, 34, 36, 38, 40 and 42 of the patterned magnetic-bias film 22 is generally rectangular or square shaped and includes an outer edge 58 furthest from the core 100 of the spiral coil inductor 16 and an inner edge 60 closest to the core 100 of the spiral coil inductor 16. The spiral coil inductor 16 includes at least 1.5 turns including an outer turn 54 and an inner turn 56. Dotted line 52 defines the start and stop position of the outer turn 54 and the start of the inner turn 56. In this embodiment the inner turn 56 is only a half turn. The outer turn 54 includes a portion of the coil 16 having an outer edge 44 furthest from the core of the coil and an inner edge 46 closest to the core 100. Similarly, the inner turn 56 of the coil 16 is defined by a segment including an outer edge 48 furthest from the core 100 of the coil 16 and an inner edge 50 closest to the core of the coil. Each of the elements 28, 30, 32, 34, 36, 38, 40 and 42 of the patterned magnetic-bias film 22 is constructed so that the outer edge 58 of each element is further from the core 100 of the coil 16 than either one of the outer edge 44 of the outer turn 54 of the coil or the outer edge 48 of the inner turn 56 of the coil. The inner edge 60 of each of the elements of the patterned magnetic-bias film 22 is positioned to be closer to the core 100 of the spiral coil 16 than either of the inner edge 46 of the outer turn 54 of the coil or the inner edge 50 of the inner turn 56 of the coil.

Still referring to FIG. 5, in one embodiment of the invention the patterned magnetic-bias film 22 has a first set of elements which includes the first element 28 and the second element 30, each of which are aligned to cover a portion of a segment of the outer turn 54 of the spiral coil inductor 16. A second set of elements includes the third element 32 and the fourth element 34. The second set of elements is positioned to be diametrically opposed to the first set of elements, and in particularly, the third element 32 is positioned to be diametrically opposed to the first element 28 and the fourth element 34 is positioned to be diametrically opposed to the second element 30. Both of the third and fourth elements 32, 34 are constructed and aligned to cover a portion of the outer turn 54 and the inner turn 56 of the coil. A third set of elements is provided and includes the fifth element 36 and the sixth element 38. The third set of elements is positioned at a right angle to the first set of elements and the second set of elements. The fifth element 36 is positioned to cover a portion of the outer turn 54 and the inner turn 56 of the spiral coil inductor 16. The sixth element 38 is positioned to cover a portion of the outer turn 54 of the spiral coil inductor 16. A fourth set of elements is provided at a position diametrically opposed to the third set of elements. The fourth set of elements includes the seventh element 40 which is positioned to cover a portion of the outer turn 54 and the inner turn 56 of the spiral coil inductor 16, and the eighth element 42 that is positioned to cover a portion of the outer turn 54 of the spiral coil inductor 16.

Figure 6:
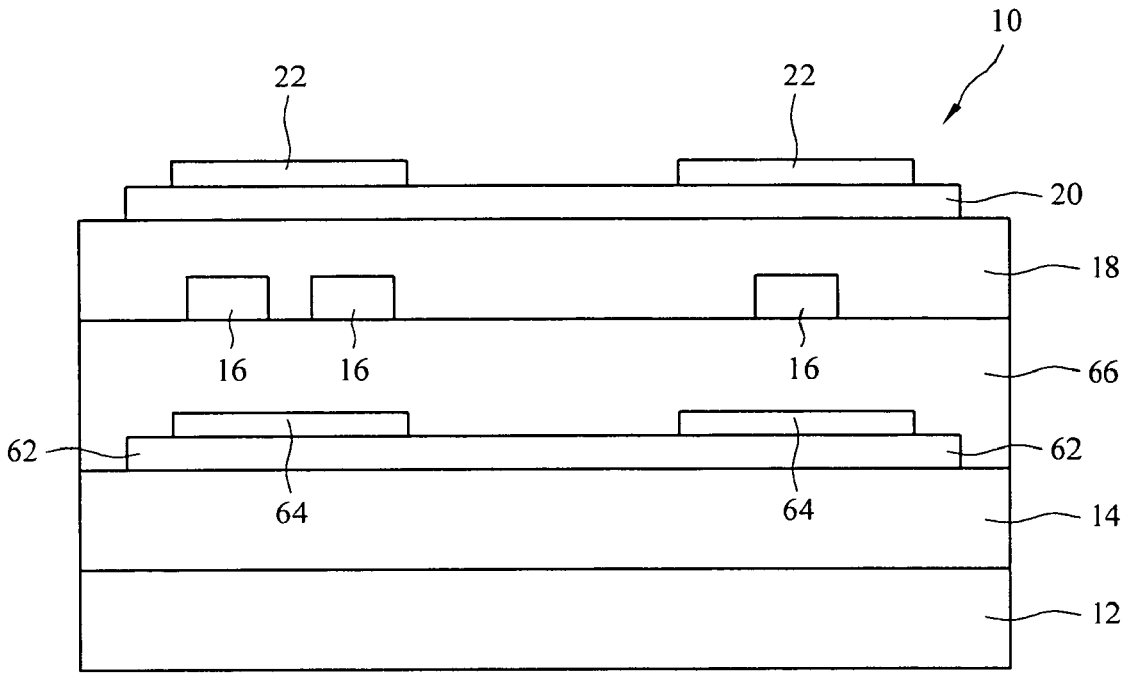
FIG. 6 illustrates another embodiment of a semiconductor device according to the present invention.

Referring now to FIG. 6, in one embodiment of the invention, a multi-layer assembly is interposed between the first insulator 14 and the spiral coil inductor 16, the multi-layer assembly including a second patterned ferromagnetic film 62 overlying the first insulator 14, and a second patterned magnetic-bias film 64 overlying the second patterned ferromagnetic film 62, and a third insulator 66 overlying the second patterned magnetic-bias film 64. The second patterned ferromagnetic film 62 and the second patterned magnetic-bias film 64 are constructed, arranged and aligned in a similar fashion to that of the first patterned ferromagnetic film 20 and the first patterned magnetic-bias film 22. However, the second patterned ferromagnetic film 62 and the second patterned magnetic-bias film 64 underlie the spiral coil inductor 16. In one embodiment, the third insulator 66 completely covers and encapsulates both the second patterned ferromagnetic film 62 and the second patterned magnetic-bias film 64.

When the terms "overlying" or "overlies" or "over" are used to describe the relative position of a first component with respect to a second component of the present invention, such shall mean that the first component may be in direct contact with the second component or that one or more layers or components may be interposed between the first component and the second component. Similarly, when the terms "under" or "underlying" or "underlies" are used to describe the relative position of a first component with respect to a second component of the present invention, such shall mean that the first component may be in direct contact with the second component or that one or more layers or components may be interposed between the first component and the second component.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A semiconductor device comprising:

a semiconductor substrate;

a first insulator overlying the semiconductor substrate;

a spiral coil inductor overlying the first insulator; a second insulator overlying the spiral coil inductor;

a patterned ferromagnetic film overlying the second insulator; and a patterned magnetic-bias film overlying the patterned ferromagnetic film;

wherein the patterned magnetic-bias film includes a plurality of individual elements, each element of the patterned magnetic-bias film constructed and aligned to completely overlie a portion of a turn of the spiral coil inductor.

2. The semiconductor device as set forth in claim 1 wherein the spiral coil inductor comprises at least one of Cu and Cu based alloys.

3. The semiconductor device as set forth in claim 1 wherein the patterned ferromagnetic film comprises at least one of Fe, Co, Ni, Mo and alloys thereof.

4. The semiconductor device as set forth in claim 1 wherein the patterned magnetic-bias film comprises iron.

5. The semiconductor device as set forth in claim 1 wherein the spiral coil inductor includes at least 1.5 turns.

6. The semiconductor device as set forth in claim 1 wherein the spiral coil inductor has a plurality of turns, and wherein the patterned ferromagnetic film is aligned to completely cover all of the turns of the spiral coil inductor.

7. The semiconductor device as set forth in claim 1 wherein the spiral coil inductor includes at least an outer turn portion furthest from a core of the spiral coil inductor and an inner turn portion closest to the core of the spiral coil inductor, and wherein the outer turn portion includes an outer edge furthest from the core of the spiral coil inductor and an inner edge closest to the core of the spiral coil inductor, and wherein the inner turn portion includes an outer edge furthest from the core of the spiral coil inductor and an inner edge closest to the core of the spiral coil inductor, and wherein the patterned magnetic-bias film includes a plurality of elements, each element constructed and arranged and aligned to cover at least one of a portion of the outer turn and a portion of the inner turn of the spiral coil inductor.

8. The semiconductor device as set forth in claim 1 further comprising a multi-layer assembly interposed between the first insulator and the spiral coil inductor, the multi-layer assembly including a second patterned ferromagnetic film overlying the first insulator, and a second patterned magnetic-bias film overlying the second patterned ferromagnetic film, and a third insulator overlying the second patterned magnetic-bias film.

9. The semiconductor device as set forth in claim 8 wherein the second patterned ferromagnetic film comprises at least one of Fe, Co, Ni, Mo and alloys thereof.

10. The semiconductor device asset forth in claim 8 wherein the second patterned magnetic-bias film comprises iron.

11. A semiconductor device comprising:

a semiconductor substrate and a first insulator overlying the semiconductor substrate;

a spiral coil inductor overlying the first insulator, and a second insulator overlying the spiral coil inductor;

a first patterned ferromagnetic film overlying the second insulator, and a first patterned magnetic-bias film overlying the first patterned ferromagnetic film;

a multi-layer assembly interposed between the first insulator and the spiral coil inductor, the multi-layer assembly comprising a second patterned ferromagnetic film overlying the first insulator, and a second patterned magnetic-bias film overlying the second patterned ferromagnetic film, and a third insulator overlying the second patterned magnetic-bias film.

12. The semiconductor device as set forth in claim 11 wherein the spiral coil inductor comprises at least one of Cu and Cu based alloys.

13. The semiconductor device as set forth in claim 11 wherein the first patterned ferromagnetic film comprises at least one of Fe, Co, Ni, Mo and alloys thereof, and the first patterned magnetic-bias film comprises iron.

14. The semiconductor device as set forth in claim 11 wherein the spiral coil inductor includes at least 1.5 turns.

15. The semiconductor device as set forth in claim 11 wherein the spiral coil inductor has a plurality of turns, and wherein both first and the second the patterned ferromagnetic film each is aligned to completely cover all of the turns of the spiral coil inductor.

16. The semiconductor device as set forth in claim 11 wherein each of the first and the second patterned magnetic-bias film includes a plurality of individual elements, each element of the patterned magnetic-bias film constructed and aligned to completely overlie a portion of a turn of the spiral coil inductor.

17. The semiconductor device as set forth in claim 11 wherein the spiral coil inductor includes at least an outer turn portion furthest from the core of the spiral coil inductor and an inner turn portion closest to the core of the spiral coil inductor, and wherein the outer turn portion includes an outer edge furthest from the core of the spiral coil inductor and an inner edge closest to the core of the spiral coil inductor, and wherein the inner turn portion includes an outer edge furthest from the core of the spiral coil inductor and an inner edge closest to the core of the spiral coil inductor, and wherein each of the first and second the patterned magnetic-bias film includes a plurality of elements, each element constructed and arranged and aligned to cover at least one of a portion of the outer turn and a portion of the inner turn of the spiral coil inductor.

18. The semiconductor device as set forth in claim 11 wherein the second patterned ferromagnetic film comprises at least one of Fe, Co, Ni, Mo and alloys thereof, and the second patterned magnetic-bias film comprises iron.

19. A semiconductor device comprising:

a semiconductor substrate;

a first insulator overlying the semiconductor substrate;

a spiral coil inductor overlying the first insulator; a second insulator overlying the spiral coil inductor;

a patterned ferromagnetic film overlying the second insulator; and a patterned magnetic-bias film overlying the patterned ferromagnetic film;

wherein the spiral coil inductor includes at least an outer turn portion furthest from a core of the spiral coil inductor and an inner turn portion closest to the core of the spiral coil inductor, and wherein the outer turn portion includes an outer edge furthest from the core of the spiral coil inductor and an inner edge closest to the core of the spiral coil inductor, and wherein the inner turn portion includes an outer edge furthest from the core of the spiral coil inductor and an inner edge closest to the core of the spiral coil inductor, and wherein the patterned magnetic-bias film includes a plurality of elements, each element constructed and arranged and aligned to cover at least one of a portion of the outer turn and a portion of the inner turn of the spiral coil inductor.

* * * * *